United States Patent [19]

Rothstein

[11] Patent Number: 4,547,136

[45] Date of Patent: Oct. 15, 1985

[54] VARIABLE DISPLACEMENT PERISTALTIC PUMP

[75] Inventor: Robert A. Rothstein, New York, N.Y.

[73] Assignee: Manostat Corporation, New York, N.Y.

[21] Appl. No.: 668,402

[22] Filed: Nov. 5, 1984

[51] Int. Cl.[4] ..... F04B 43/12; F04B 45/08

[52] U.S. Cl. ..... 417/475; 417/477

[58] Field of Search ..... 417/475, 476, 477

[56] References Cited

U.S. PATENT DOCUMENTS

| | | | |
|---|---|---|---|
| 3,684,408 | 8/1972 | Maclin | 417/477 |
| 3,816,033 | 6/1974 | Fried et al. | 417/477 X |
| 4,392,794 | 7/1983 | Foxcroft | 417/477 X |

FOREIGN PATENT DOCUMENTS

| | | | |
|---|---|---|---|
| 568741 | 10/1977 | U.S.S.R. | 417/475 |

*Primary Examiner*—Richard E. Gluck

*Attorney, Agent, or Firm*—Abelman Frayne Rezac & Schwab

[57] ABSTRACT

A variable displacement peristaltic pump includes an stator carrying a flexible resilient tube, and a spoke-like array of pinch rollers for cooperation with the flexible tube. The rollers extend radially of the axis of a driven rotor, the stator and tube extending tangent to the axis of rotation of the rotor and being adjustable radially of the rotor axis, thus providing for adjustment and calibration of the pump output.

7 Claims, 6 Drawing Figures

48
40
44
42
50
38
36
32
30
30
16
24
20
22
14

VARIABLE DISPLACEMENT PERISTALTIC PUMP

FIELD OF THE INVENTION

This invention relates to a peristaltic pump for use in metering and transferring liquids. Such pumps are of particular use in metering and transferring liquids in a sterile environment, or conversely, in metering and transferring noxious or contaminated liquids in a totally isolated environment.

BACKGOUND OF THE INVENTION

Fixed displacement peristaltic pumps are well known, such pumps incorporating a rotor which is driven at a determined speed by an electric motor, the rotor being provided with pinch rollers that are mounted in the periphery of the rotor for rotation about axes parallel to the axis of rotation of the rotor.

The liquid to be metered and transferred is confined within a flexible and resilient tube, the tube being supported on an arcuate support bed of a stator positioned proximate to the rotor periphery. The pinch rollers progressively impinge on the tube as the rotor rotates to compress the tube against the arcuate support bed with a travelling pinch effect. In this manner, a determined volume of fluid is trapped within the tube between adjacent travelling pinches of the rollers, and is moved axially through the tube at a rate determined by the speed of rotation of the rotor.

Such pumps rely in their metering capacity on the selection of a tube having a bore of appropriate diameter, and on the rotation of the rotor at a closely controlled determined speed. In pumps of this type, differences in the bore diameter of the tubing arising from manufacturing tolerances or due to internal pressure or other conditions will affect the volume of liquid delivered by the pump when driven at a selected constant speed.

Further considerations affecting the accuracy of metering of such pumps arise from viscosity of the pumped liquid, the back pressure imposed on the pumped liquid, and manufacturing tolerances in the rotor and pinch roller assembly. Such manufacturing tolerances can result in variation in the diameter of the rollers, with consequential variation in the volume of liquid confined between adjacent pinches of the rollers, and, in the event that the rollers are undersized, the possibility of back flow through the pinches in the tubing due to insufficient compression of the tubing at the pinches. Also, lack of concentricity of the rollers or of the rotor, and lack of paralellism of the roller and rotor axes can produce inaccuracies in the pump output.

Such pumps are limited in their application to pumps having fixed displacement, unless some form of variable speed drive is provided for the rotor, or, a variable speed motor is employed and provision is made for accurately maintaining the motor speed constant at the selected speed. Speed controls of the sophistication required are both complicated and expensive.

Attempts have been made to overcome these disadvantages, and to provide a peristaltic pump in which variation of the pump displacement is provided, and, calibration of the pump can be effected. Examples of such pumps are to be found in U.S. Pat. No. 3,955,902 Kyvsgaard issued May 11, 1976, and in U.S. Pat. No. 4,132,509 Bongartz issued Jan. 2, 1979. These patents teach the formation of the arcuate bed for it to be of conical form, and the support of the rollers for their axes to be inclined to the axis of rotation of the rotor.

In this manner, for a constant angular velocity of the rotor, the linear velocity of the rollers progressively increases as the radius of contact between the rollers and the tube progressively increases, provision being made for adjustment of the position of the tube axially of the conical surface of the support bed. Movement of the tube from the smaller radius end of the conical surface of the anvil towards the larger radius end progressively increases the displacement of the pump, and vice versa. Thus, for any selected tube, adjustment of the pump displacement within determined ranges can be effected, and, calibration of the pump at the selected delivery rate can be effected.

Such pump constructions must, however, be very large in order to provide substantial variations in the displacement of the pump, in that the peripheral velocity of the rollers at any selected radius from the rotor axis is a function of the selected angular velocity of the rotor and the angle at which the axes of the rollers are inclined to the axis of the rotor.

Further, adjustment of the tubing axially of the conical support bed results in a change in the length of the tubing supported by the bed, and also results in a change in the radius of the arc to which the tubing is bent, with a consequential change in the volume of the bore. Also, and most importantly, some provision must be made for holding the tubing in fixed position in a plane perpendicular to the rotor axis throughout the length of the arc, and for preventing wandering of the tubing up or down the conical support bed and consequential variations in the radius of the arc.

SUMMARY OF THE INVENTION

According to the present invention, a peristaltic pump is provided in which the rollers are supported by the rotor in a spoke-like formation for rotation about axes extending radially of the axis of rotation of the rotor and perpendicular thereto, instead of parallel or inclined thereto. The tube supporting bed of the stator is axially straight and is positioned laterally of the plane of movement of the axes of the rollers, the tube supporting bed extending tangential to the rotor axis, and being supported for adjustment towards or away from the rotor axis in a radial direction parallel to a radius of the rotor axis.

In this manner, by simple adjustment of the tube supporting bed towards or away from the axis of the rotor, a wide range of linear velocities of the rollers is selectable, and thus, a wide range of volumetric displacement of the pump is made available. Further, calibration of the pump can be effected in an extremely simple and rapid manner by micrometer type adjustment of the position of the tube supporting bed in a direction radially of the rotor axis and parallel to the said tangent thereto.

By appropriately forming the pump as a pre-assembled unit in the manner of a cartridge, the rapid exchange of a pump can be effected simply by removing the cartridge from a main frame having a drive shaft and by replacing it by another cartridge of the same or of a different pumping characteristics.

BRIEF DESCRIPTION OF THE DRAWINGS

The invention will now be described with reference to the accompanying drawings, which illustrate a nonlimiting preferred embodiment of the invention, and, in which.

DESCRIPTION OF THE PREFERRED EMBODIMENT

Figure 1:
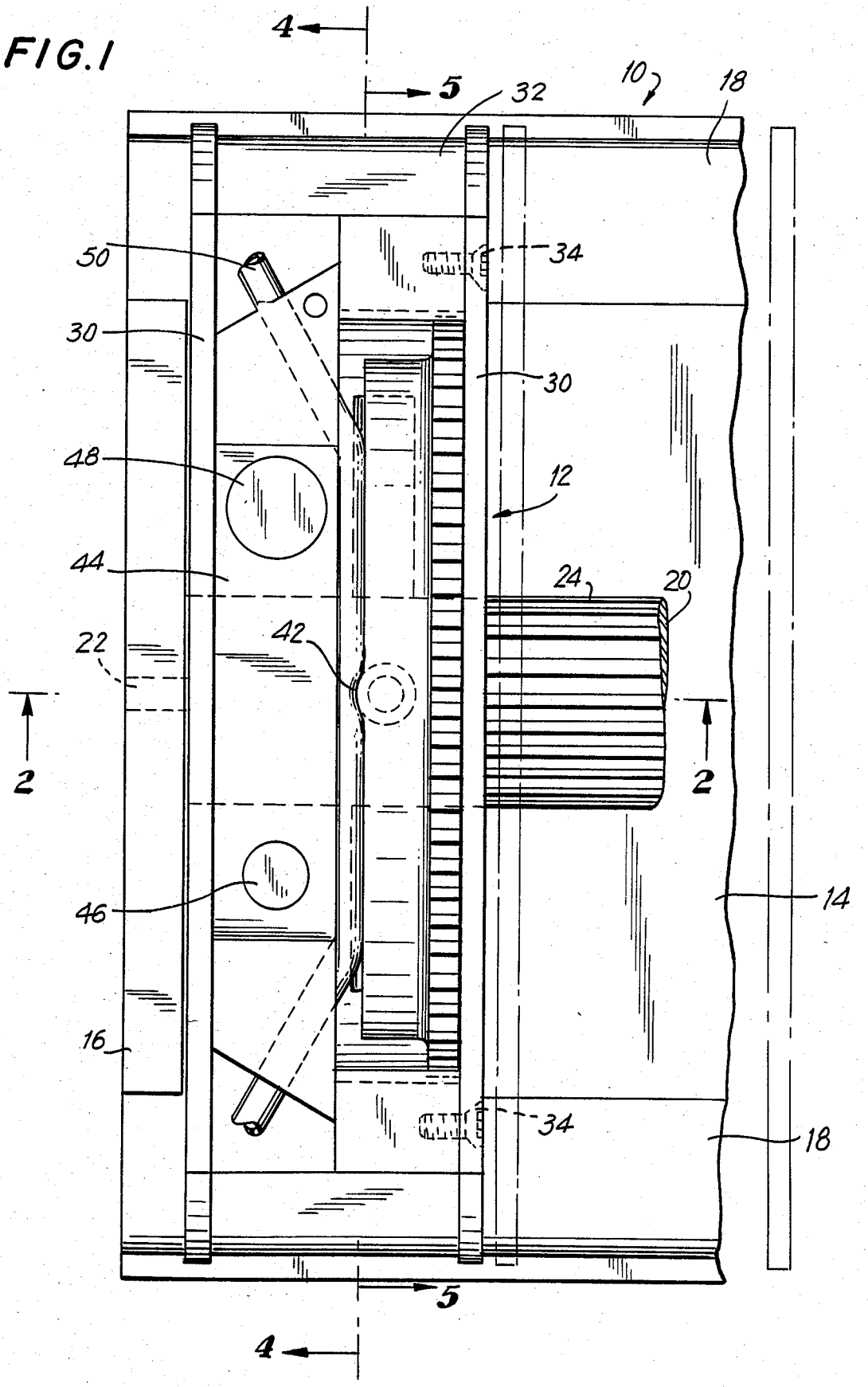
FIG. 1 is a plan view of the peristaltic pump of the present invention.
Figure 2:
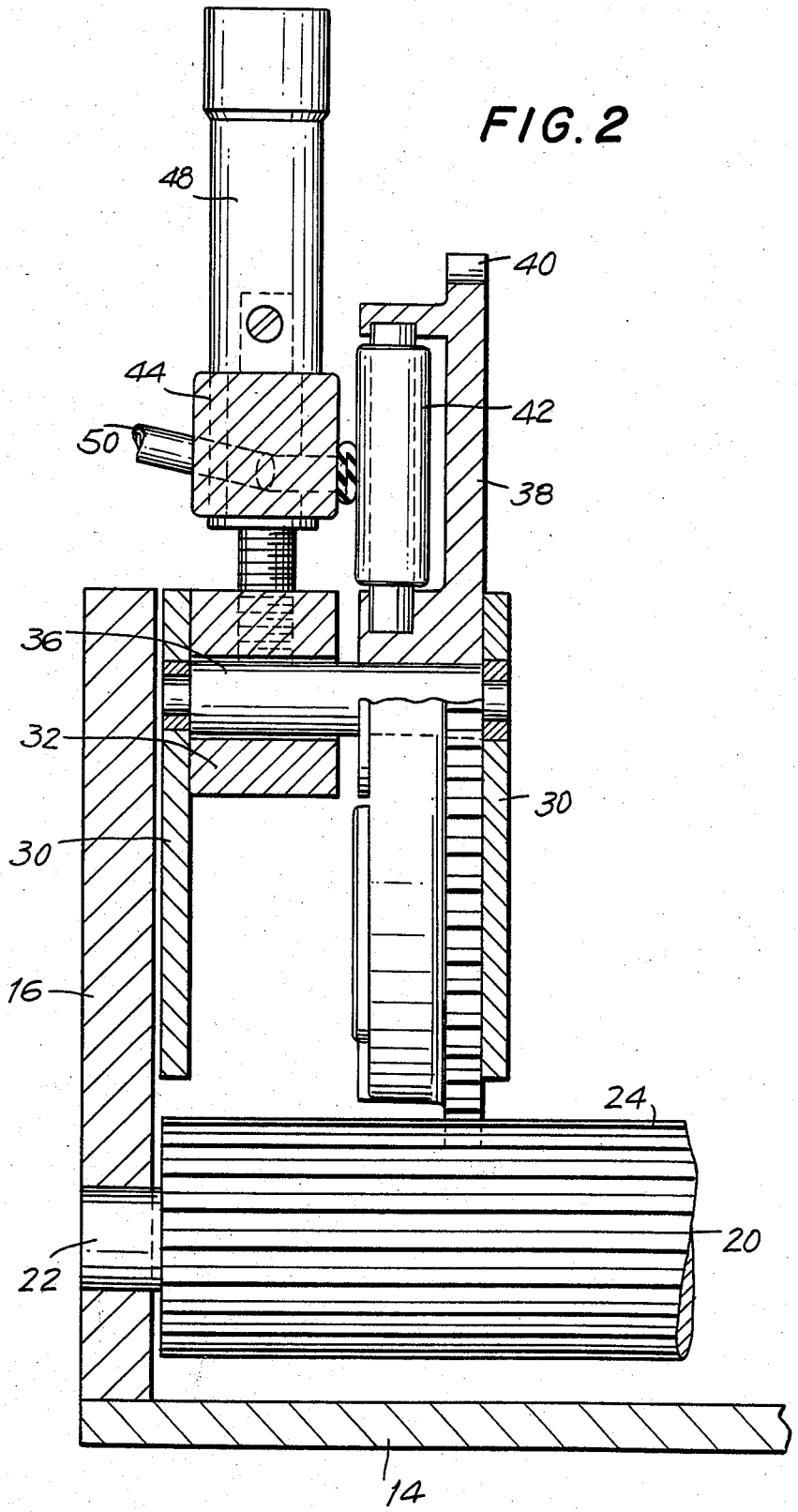
FIG. 2 is a cross-section through the pump taken on the line 2—2 of FIG. 1.
Figure 6:
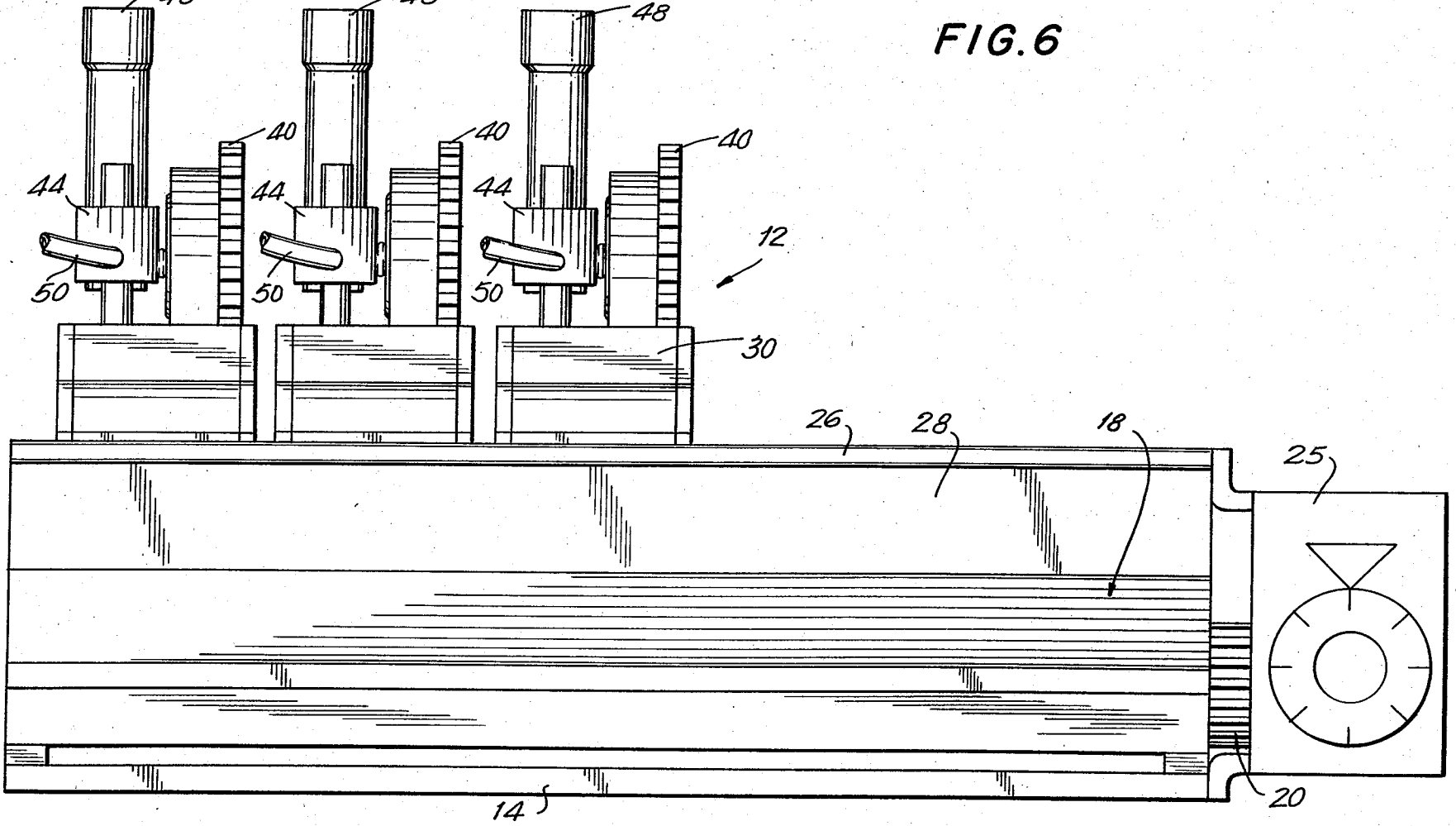
FIG. 6 is a view showing a plurality of cartridges received in a main frame.

Referring to the drawings, the pump of the present invention comprises two readily separable structures, the first being a main frame indicated generally at 10, which is specifically adapted to support and positionally locate one of a plurality of pumps in cartridge form, one of such cartridges being indicated generally at 12 in FIG. 1, and FIG. 6 showing a plurality of cartridges inserted into a main frame.

The main frame 10 comprises a supporting base 14 having end members 16 rigidly attached thereto, only one of the end frame members being shown in the drawings. Extending between the end frame members 16 are side rails 18, the side rails providing a general enclosure for the base, and also providing for the positioning and support of cartridges to be inserted into the main frame as requirements dictate.

The main frame 10 comprises a trough-like structure which is open at the top, and through which a central drive shaft 20 extends. The shaft 20 is supported in end journal bearings 22, only one of which appears in the drawings, and is provided with longitudinal gear teeth 24 extending continuously along the length of the shaft. The drive shaft 20 is to be driven by a motor 25 operable at a selected constant speed, an appropriate gear reduction (not shown) being incorporated in the drive in the event that it is found necessary. The motor may either be a selectable speed continuously rotating motor, a stepping motor, or any other device producing a determined constant angular velocity of the drive shaft 20.

The cartridges 12, which may be of any number that can be accommodated within the length of the main frame 10, are inserted directly into the main frame 10 for them to rest on the side rails 18, the cartridges being freely removeable from the main frame, and being unsupported other than by the side rails themselves.

To provide for the proper positioning of the respective cartridges, the side rails are provided with oppositely extending horizontal flanges 26 which support the cartridges, and which extend horizontally from vertically oriented flanges 28. The flanges 28 are spaced from each other sufficiently to permit easy insertion of a cartridge between the flanges, but are sufficiently closely spaced as to prevent the cartridges from moving out of their positions aligned axially of the main frame 10 and transverse thereto.

Figure 4:
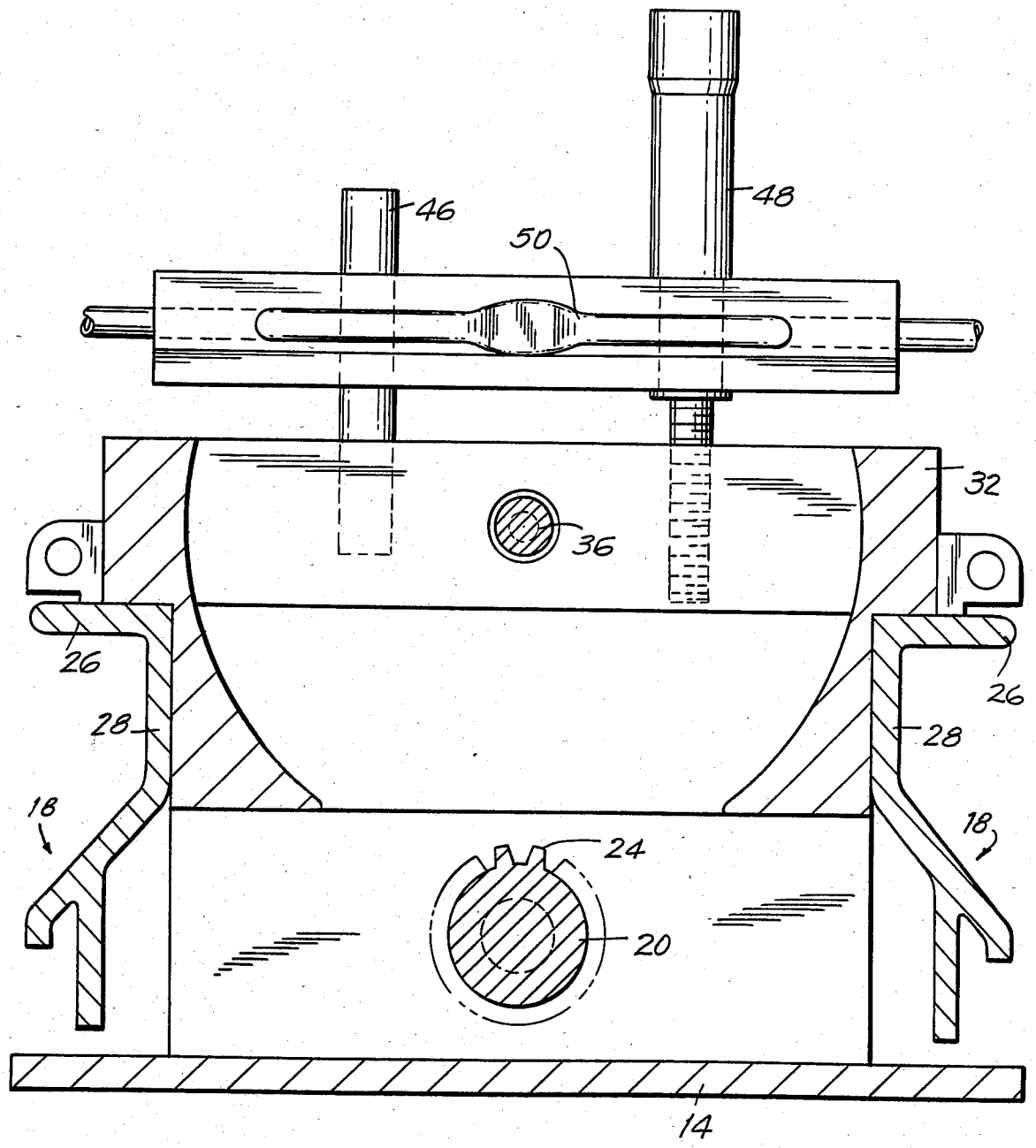
FIG. 4 is a sectional side elevation taken on the line 4—4 in FIG. 1.

The respective cartridges 12 are each of identical construction, an comprise spaced plate-like side members 30, formed from, for example, stainless steel or any other suitable material having sufficient strength and dimensional stability. The side members 30 are held spaced by and are attached to a central bridge member 32, which, as more clearly illustrated in FIGS. 4 and 5 extends between the ends of the cartridge and seats on and engages the respective horizontal and vertical flanges 26 and 28 of the main frame. The central bridge member 32 may be formed from a suitable plastics material, the side members 30 being attached to the central bridge member by means of screws 34. In this manner, an extremely sturdy and stable main body of the cartridge is provided, within which the various members of the pump now to be described are positioned and supported in an entirely stable manner precluding their accidental displacement during operation of the pump, such as when inserting a cartridge into the pump, or, under the influence of vibrations produced in operation of the pump.

Extending between the side members 30 is a shaft 36, the ends of which are journaled in suitable antifriction bearings of any convenient type that will permit ready rotation of the shaft 36 about its longitudinal axis.

Rigidly mounted on the shaft 36 is a rotor 38, the rotor being provided on its periphery with gear teeth 40, the diameter of the rotor being such that the teeth will engage with the gear teeth 24 of the drive shaft 20 automatically upon insertion of the cartridge into the main frame 10.

Figure 3:
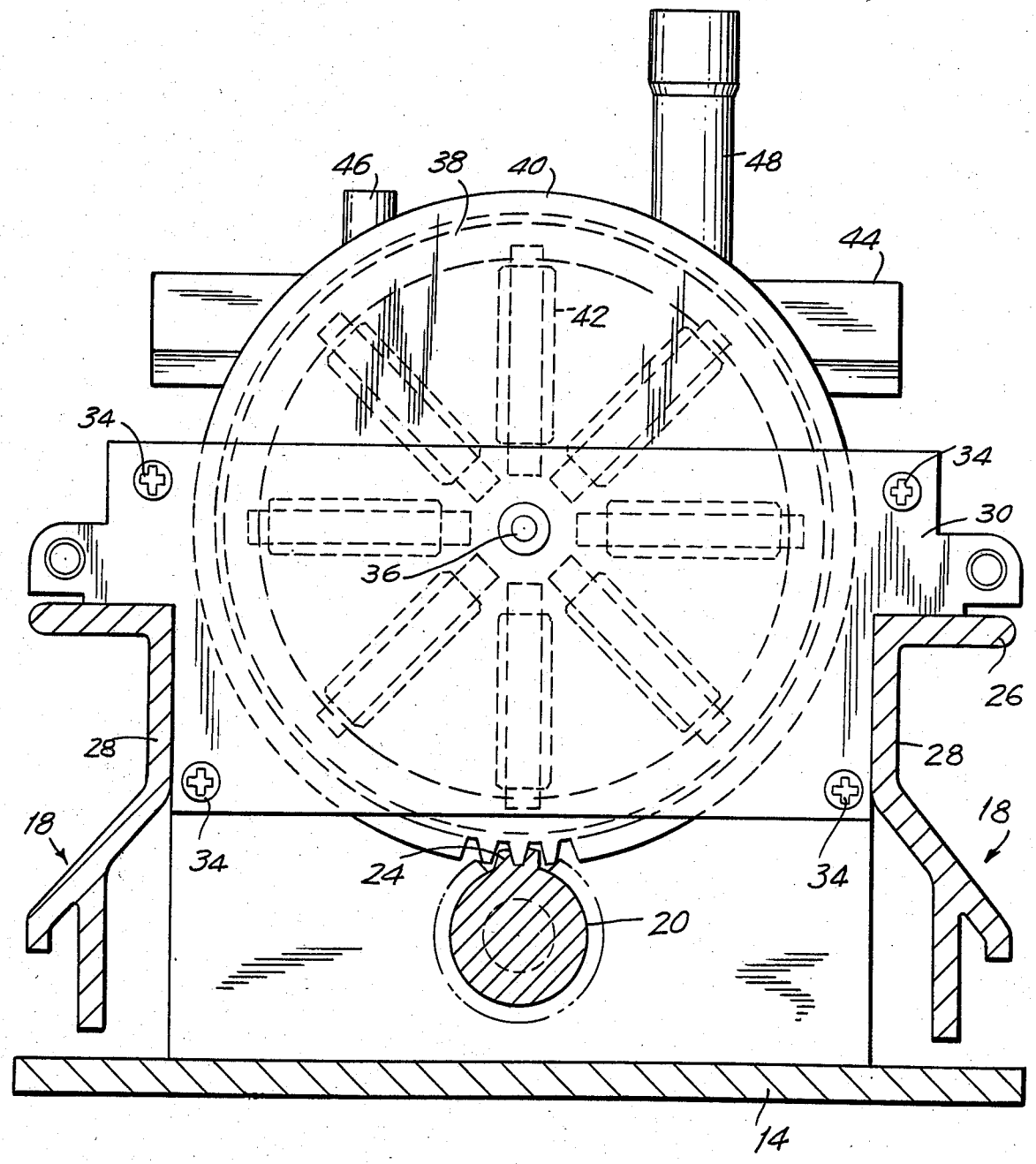
FIG. 3 is a side-elevation of the pump taken from the right-hand side of FIG. 1.
Figure 5:
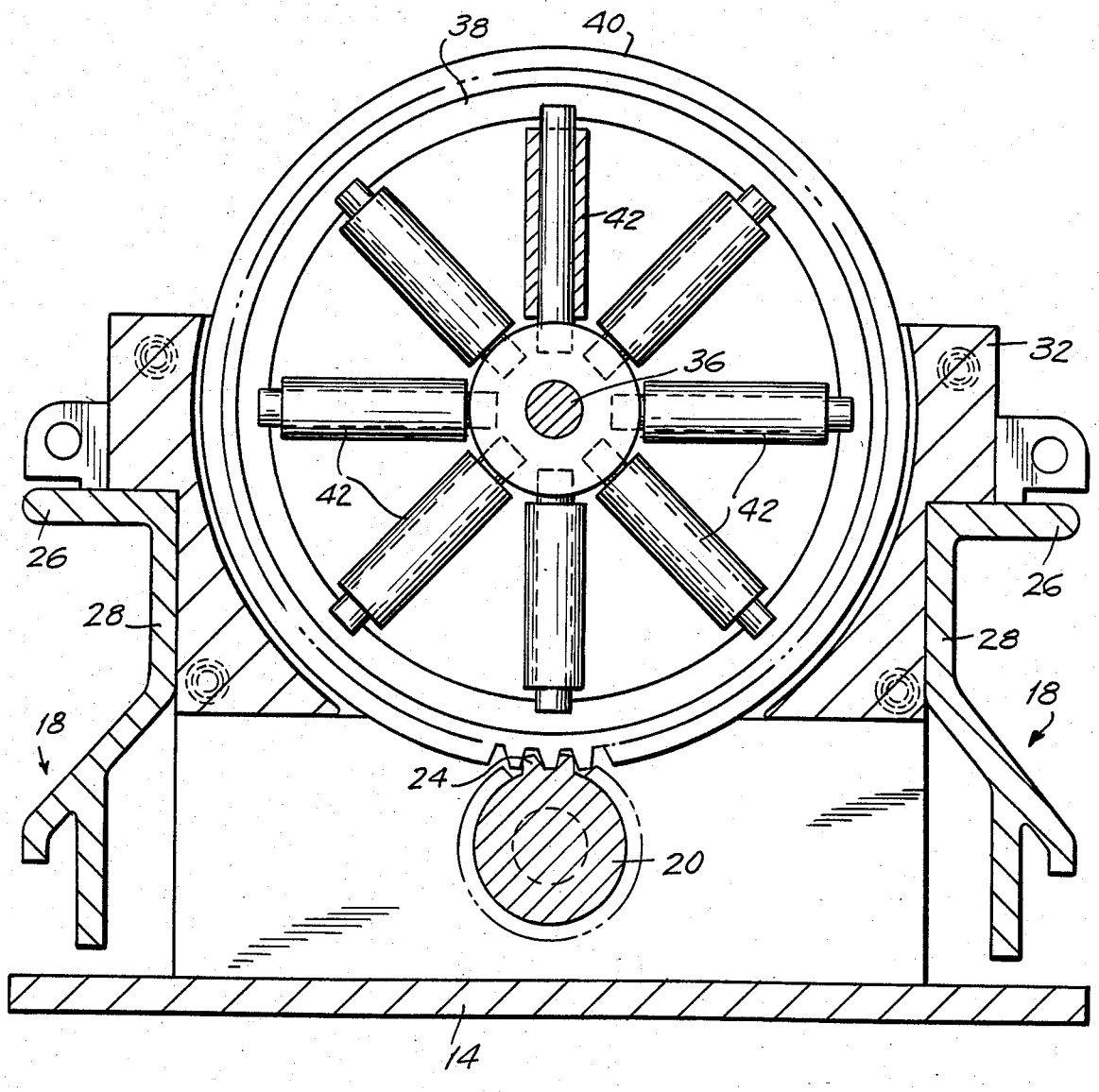
FIG. 5 is a sectional side elevation taken on the line 5—5 in FIG. 1.

Supported within the rotor 38 for rotation about axes perpendicular to the longitudinal axis of the shaft 36 and radial thereto are a plurality of pinch rollers 42, the rollers being arranged in a spoke-like formation, as more clearly illustrated in FIGS. 3 and 5. Preferably, the rollers are provided with a surface covering a relatively stiff but resilient plastics material, the rotor itself being formed from a rigid plastics material having a low coefficient of friction. The rollers thus can be supported directly by the rotor, and separate antifriction bearings are eliminated.

Preferably, the pinch rollers 42 are of the same diameter as each other, and, are arranged with their central axes lying in a single plane extending radially of and perpendicular to the longitudinal axis of the shaft 36. Thus, upon rotation of the rotor 38, the respective rollers will orbit in a plane about the axis of the shaft 36, and, if frictionally restrained during rotation of the rotor , will rotate about their own longitudinal axis.

Mounted on the central bridge member 32 and supported thereby is a stator 44 including a tube supporting bed, the stator 44 being slideable on a post 46 immovably supported by the central bridge 32. The stator 44 is movable in parallelism with the central bridge 32 under the control of a micrometer type screw mechanism 48. Thus, the stator 44 is movable towards or away from the longitudinal axis of the shaft 36.

Extending through the stator 44 is a tube of resilient flexible material 50 through which the liquid to be pumped passes. That portion of the tube 50 on which the pumping operation is performed is located on a front face of the stator and is positioned in proximity to the rollers 42. The spacing betwen the operative face of the stator 44 and the adjacent periphery of the rollers 42 as they traverse the tube supporting bed of the stator is slightly less than the thickness of the tube when in a collapsed and compressed condition. The tube 50 is thus pinched by the pinch rollers 42 as the rotor rotates, and the liquid confined within the bore of the tube 50 is propelled longitudinally of the tube bore.

In order to provide for variation of the displacement of the pump and calibration thereof, the stator 44 and the tube 50 are moved bodily towards or away from the axis of the shaft 36 under the control of the screw mechanism 48 and the sliding support of the post 46. If the stator is moved towards the shaft 36, then, the tube 50 will encounter a surface of the pinch roller peripheries that is moving at a lower linear velocity, and, vice versa, if the stator is moved away from the shaft 36, the tube 50 will encounter a surface of the pinch roller peripheries that is moving at a higher linear velocity.

The linear velocity of the pinch rollers 42 encountered by the tube 50 will be a function of the constant angular velocity of the rotor 38 and the radius from the axis of the shaft 36 at which engagement of the rollers with the tube 50 occurs. Minor pressure surges will occur within the tube 50. Such pressure surges are, however, minor in nature, and readily can be absorbed in the flexibility and resiliency of the tube itself. The pinch rollers themselves automatically compensate for the pressure surges, in that as their axes move towards the vertical postion there will be a deceleration of the peripheral speed of the rollers, which will then progressively accelerate as the axes of the respective rollers moves away from vertical position.

Having first determined the approximate required displacement of the pump by the selection of a cartridge having a tube with a bore of an appropriate diameter, the pump then can be adjusted to the desired displacement and calibration by appropriate actuation of the micrometer type screw mechanism.

Various modifications are contemplated falling within the scope of the appended claims. While an in-line arrangement of the cartridges has been disclosed, clearly, plural in-line arrangements of such cartridges in dual or multiple banks is possible by angling the respective longitudinal banks relative to each, and, by appropriately increasing the diameter of the drive shaft 20 such that each cartridge of each bank automatically will engage with the drive shaft 20 as the cartridge is inserted into the main frame.

What is claimed is:

1. A variable displacement peristaltic pump, comprising:

a housing;

a rotor supported in said housing for rotation about the longitudinal axis of said rotor;

rotatable pinch rollers carried by said rotor and arranged in a spoke-like array with the rotational axis of each said pinch roller extending radially of said rotor axis and movable in a plane perpendicular to said rotor axis;

a stator adjustably supported by said housing in adjacent parallelism with the plane of movement of said pinch rollers;

adjustment means for moving said stator relative to said rotor axis along a line perpendicular to said rotor axis; and resiliently flexible tube means carried by said stator and interposed between said stator and said pinch rollers, said pinch rollers engaging and compressing said tube with a travelling pinch action.

2. The variable displacement peristaltic pump of claim 1, further including means for rotating said rotor about said longitudinal axis at a constant angular velocity.

3. The variable displacement peristaltic pump of claim 1, in which said housing is insertable into a main frame assembly incorporating a drive shaft adapted to be rotated at determined angular velocity, a periphery of said rotor extending externally of said housing for driven engagement by said drive shaft.

4. The variable displacement peristaltic pump of claim 3, in which said drive shaft includes longitudinally extending gear teeth, and, the periphery of said rotor includes corresponding gear teeth for driven engagement by the gear teeth of said drive shaft.

5. The peristaltic pump of claim 1, including at least one guide and support member carried by said housing and extending perpendicular to the axis of said rotor, and means for positionally adjusting said stator in said guide relative to said rotor axis.

6. The variable displacement peristaltic pump of claim 5, in which said positional adjustment means is a micrometer type screw-threaded member threadedly supported by one of said housing and stator and reacting against the other of said housing and stator.

7. The variable displacement peristaltic pump of claim 3, in which said main frame and said drive shaft are elongate, and are adapted to receive a plurality of said pumps in axially stacked array, each said housing, rotor, stator, tube and adjustment means comprising a cartridge-like subassembly for selective insertion into and removal from said main frame.

* * * * *